United States Patent [19]

Darnell

[11] Patent Number: 4,768,619

[45] Date of Patent: Sep. 6, 1988

[54] FIRE ESCAPE DEVICE

[76] Inventor: George Darnell, P.O. Box 589, Captain's Harbor, Condo 206, Bokeelia, Fla. 33922

[21] Appl. No.: 122,075

[22] Filed: Nov. 18, 1987

[51] Int. Cl.[4] ..... A62B 1/20

[52] U.S. Cl. ..... 182/129; 182/100; 182/190; 182/206

[58] Field of Search ..... 182/100, 189, 190, 129, 182/206; 57/230

[56] References Cited

U.S. PATENT DOCUMENTS

| | | | |
|---|---|---|---|
| 190,829 | 5/1877 | Costantino . | |
| 645,677 | 3/1900 | Wingert | 182/190 |
| 689,662 | 12/1901 | Tucker | 57/230 |
| 1,300,870 | 4/1919 | Plush . | |
| 1,914,889 | 6/1933 | Lugara . | |
| 3,477,543 | 11/1969 | Vigluicci | 182/100 |
| 3,664,457 | 5/1972 | York . | |
| 4,161,266 | 7/1979 | Howarth, Jr. . | |
| 4,161,998 | 7/1979 | Trimble . | |

FOREIGN PATENT DOCUMENTS

| | | | |
|---|---|---|---|
| 47688 | 5/1916 | Denmark | 182/76 |
| 2167954 | 6/1986 | United Kingdom | 182/100 |

*Primary Examiner*—Reinaldo P. Machado
*Attorney, Agent, or Firm*—Amster, Rothstein & Ebenstein

[57] ABSTRACT

A fire escape device for use in escaping from a structure through the screen of a screened-in area comprising in combination an elongate fire escape rope, a screen cutting knife, and a connector securing the knife to the rope adjacent one end of the rope.

1 Claim, 2 Drawing Sheets

FIRE ESCAPE DEVICE

BACKGROUND OF THE INVENTION

The present invention relates to fire escape devices, and more particularly to a fire escape device for use in escaping from a structure through the screen of a screened-in area.

Apartment houses, such as the low rise condominiums on the West Coast of Florida, are frequently provided with screened-in terraces and windows to protect tenants from the flying insects prevalent in the area. The only means of egress from such an apartment, other than the single front door, may be the screened-in terrace or window. In the event of a fire which precludes egress through the front door, the only way for the occupant to reach safety (whether that be the ground or the apartment immediately below) may be by way of the terrace or window. While the window screens are typically at least partially removable, the size and location of the window may render it unsuitable as an egress, especially for the elderly or handicapped. On the other hand, the larger and more accessible terraces are typically provided with fixed screens which are not easily removed, certainly not in the presence of an adjacent fire with the attendant smoke interfering with clear vision, calm breathing and deliberative minds.

Thus even those few who are foresighted enough to provide themselves with some sort of emergency fire escape means (for example, ropes, ladders, or the like), so that they can escape from the apartment by going down the outside of the building, may find themselves stymied by the presence of a screen which interferes with their access to the outside of the building via the terrace or window. Cutting means (such as a knife) in the kitchen or tool chest may not be sufficient where the flames, smoke or sheer panic render these locations as a practical matter unavailable. Especially where the fire is well developed before the tenant becomes aware of it, thereby may be simply be insufficient time for a special trip to the kitchen or the tool box prior to bringing the fire escape means into play.

For those fortunate enough to live on the lower floors, only a relatively short length of fire escape means (e.g., ladder or rope) is required in order to reach the safety of the ground. For those living on the upper floors, a comparatively short length of fire escape means might enable them to reach one or more apartments immediately below them, but the presence of a screen would again stand between them and safety unless the cutting means were also available to breach the screen of the apartments below.

Accordingly, it is an object of the present invention to provide a fire escape device for use in escaping from a structure through the screen of a screened-in area.

Another object of is to provide such device which enables a fire escape means (such as a rope) and a screen cutting means (such as a knife) to be stored in handy proximity and brought to the screen of a screened-in area together.

A further object is to provide such a device wherein the screen cutting knife is accessible for use in cutting the screen of a screened-in area belonging to an apartment below.

It is another object of the present invention to provide such a device which is of sturdy, rugged and economical construction.

SUMMARY OF THE INVENTION

A fire escape device for use in escaping from a structure through the screen of a screened-in area comprises in combination elongate fire escape means, screen cutting means, and means securing the cutting means to the escape means adjacent one end of the escape means.

In a preferred embodiment, the escape means has a first end adapted to be secured to the structure and a second end adapted to the moved through a cut screen, the second end being the one secured to the cutting means. The escape means may include a non-combustible core extending from the fire end for at least a length thereof.

Preferably the escape means comprises a hank of knotted rope, the cutting means comprises a dull blade, and the securing means permanently secures the cutting means to the escape means. The cutting means may comprise a knife with a blade having a cutting edge, the blade being movable between a first orientation exposing the cutting edge for cutting and a second orientation precluding the cutting edge from cutting.

BRIEF DESCRIPTION OF THE DRAWING

The above brief description, as well as further objects and features of the present invention, will be more fully understood by reference to the following detailed description of the presently preferred, albeit illustrative embodiments of the present invention when taken in conjunction with the accompanying drawing wherein.

DETAILED DESCRIPTION OF THE PREFERRED EMBODIMENTS

Figures 1, 2, 3:
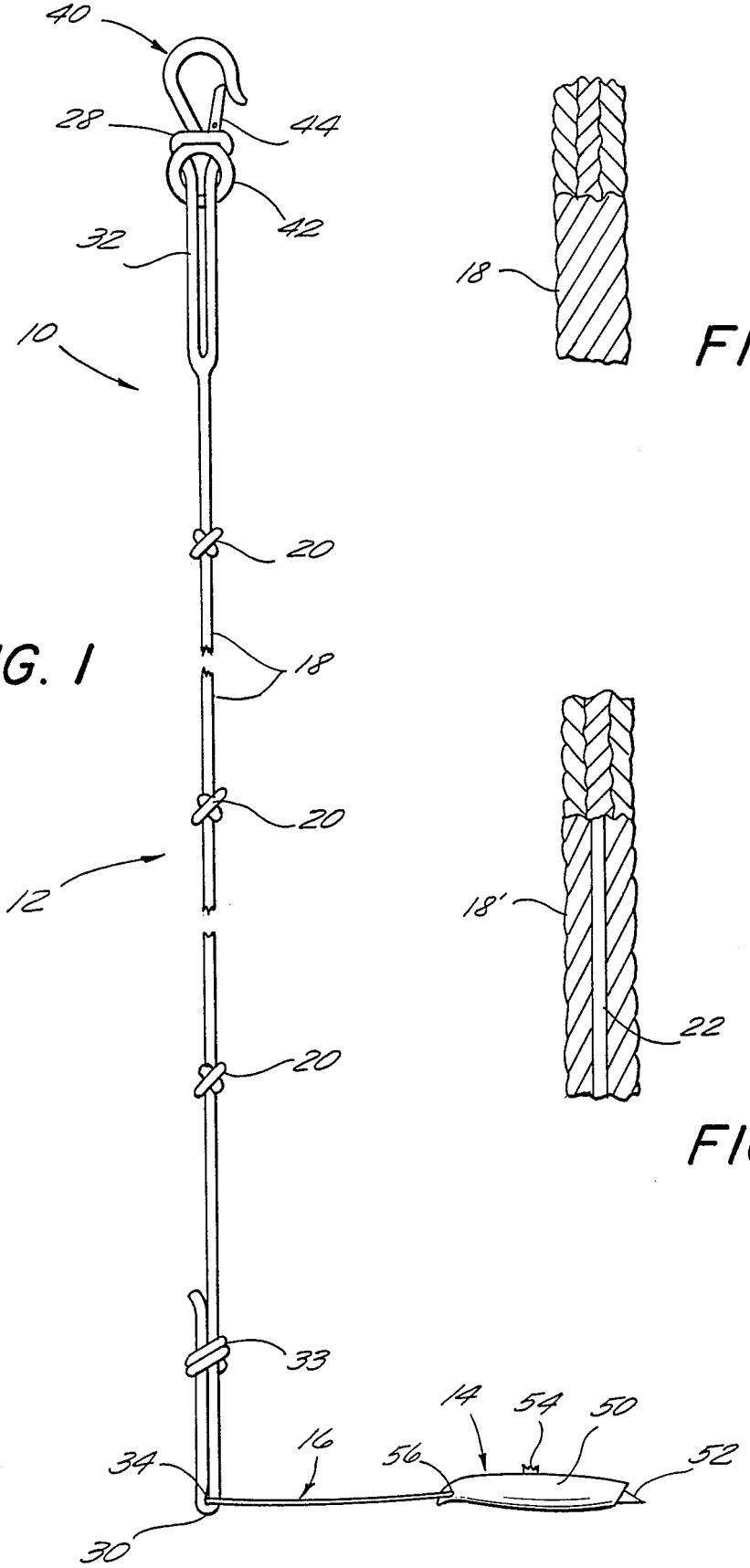
FIG. 1 is a side elevation view of the fire escape device of the first invention.
FIG. 2 is a fragmentary cross-sectional view of the fire escape rope, to a greatly enlarged scale, with portions cut away to reveal details of internal construction.
FIG. 3 is a view similar to FIG. 2 of another embodiment of the fire escape rope.

Referring now to the drawing and in particular in FIG. 1 thereof, therein illustrated is a fire escape device of the present invention, generally designated by the reference numeral 10. Generally speaking, the fire escape device 10 comprises an elongate fire escape means generally designated 12, a screen cutting means generally designated 14 and securing means generally designated 16 for securing together the cutting means 14 and the escape means 12 adjacent one end of the escape means. More particularly, the elongate fire escape means 12 may be a rope, a flexible ladder or any other elongate means for enabling a person to climb down from an upper floor of a building to the ground or at least to the floor immediately below, depending on the length of the elongate means. As illustrated, the escape means 12 is a rope 18 having knots 20 spaced along a length thereof to serve as handgrips and thereby facilitate a controlled descent along the escape means 12. The knots or handgrips 20 are preferably regularly spaced along the length of the escape rope 11 and serve the function of rungs in a ladder.

Referring now to FIGS. 2 and 3, the elongate fire escape means 12 may comprise a standard multi-braid rope 18, such as the 3-braid rope illustrated in FIGS. 1 and 2, or a special rope 18' having, over at least a portion of its length, a non-combustible core 22 of wire or other fire-resistant material, as illustrated in FIG. 3. Preferably at least the length of the escape means 12 remaining within an apartment or on a terrace during use of the fire escape device 10 (i.e., the length most likely to be first exposed to the fire) is formed of special rope 18' and, if desired, the entire length may be so formed.

Referring again to FIG. 1 in particular, the fire escape means 12 has a first or upper end 28, adapted to be retained within the apartment or terrace when the fire escape 10 device is in use, and a second or bottom end 30, adapted to be lowered down the exterior of the building toward the ground. The rope 18 adjacent the upper end 28 thereof bifurcates to form a closed loop 32 and adjacent the lower end 30 of the rope is folded back on itself and tied at 33 so as to form a loop 34. The loop 32 adjacent upper end 28 is secured to a conventional hook generally designated 40. The hook 40 includes an enlarged circular base 42 defining a central aperture and a locking element 44 biases to close the bight of the hook 40. The purpose of the hook is to enable the upper end 28 of the escape means 12 to be secured to a structural element of the apartment or furniture therewithin as an anchor. The precise form or shape of the hook is not a part of the present invention and, indeed, the hook 40 may be dispensed with entirely and the end 28 simply looped over the appropriate structural element or furniture of the apartment. In fact, the loop 32 may be dispensed with totally and the end 28 merely tied around the appropriate structural element or furniture of the apartment. Similarly, the loop 34 at the lower end 30 of the escape means 12 is simply to facilitate securing of the escape means 12 to the cutting means 14 and, like the loop 32, may be dispensed with entirely. For example, as will be described in greater detail hereinbelow, the lower end 30 of rope 18 may directly serve the function of connecting the cutting means 14 to the upper segment of the rope 18 serving as the escape means 12.

The screen cutting means 14 comprises a standard utility knife of the type readily available in hardware stores. The knife 14 includes a handle handle or housing 50, a blade 52 and positioning means 54 for causing the blade 52 to move between positions wholly within and partially without the housing 50. The housing 50 may include an aperture 56 therethrough. While a knife 14 may be employed which has the blade 52 in a fixed orientation relative to the housing 50 so that the cutting edge of the blade 52 is always available for cutting, this can lead to accidental cutting of the user as he attempts to deploy the fire escape device 10 under conditions of smoke, excitement and haste. For the sake of safety, it is desirable that the blade 52 be movable by a positioning means 54 between a first orientation exposing the cutting edge thereof for cutting (for example, by having a portion of blade 52 extending beyond the front of housing 50, as illustrated) and a second orientation precluding the cutting edge from cutting (for example, by keeping the blade 52 wholly within the housing 50). Also as a safety measure, the blade 52 may be relatively dull as there is little advantage in the use of a sharp blade for cutting wire screens and a dull blade is far less likely to cause accidental injury to the user.

The means 16 for securing the cutting means 14 to the escape means 12 adjacent its lower end 30 may be a simple lanyard, chain, cord or the like. The securing means 16 is preferably configured as a closed loop with one end of the securing means 16 being secured to the escape means 14—for example, by passing through the aperture 56 of the cutting means housing 50—and the other end thereof being secured to the escape means 12—for example, by passing through the loop 34 adjacent the escape rope end 30. Alternatively, the securing means may comprise a linear length of material tied at one end to the escape means 12 and at the opposite end to the cutting means 14. Preferably the securing means 16 is of relatively light weight construction relative to the fire escape rope 18 and is at least 4 feet in effective length (that is, it enables the cutting means 14 and escape rope end 30 to be spaced apart by that distance). This permits the cutting means 14 to be more easily maneuvered to cut the screen of a screened-in area, without the need for the user to unduly move about the necessarily relatively heavy escape rope 18. As noted above, in an alternate embodiment of the present invention wherein the aperture 56 of the cutting means 14 is sufficiently large to receive the thickness of the escape rope 18, a lower portion of the escape rope 18 may serve as the securing means 16 to secure the cutting means 14 to the upper portion of the escape rope 18, the latter then constituting the elongate fire escape means 12. In other words, in the alternate embodiment, the escape rope 12 comprises both the escape means 12 and the securing means 16.

Figure 4:
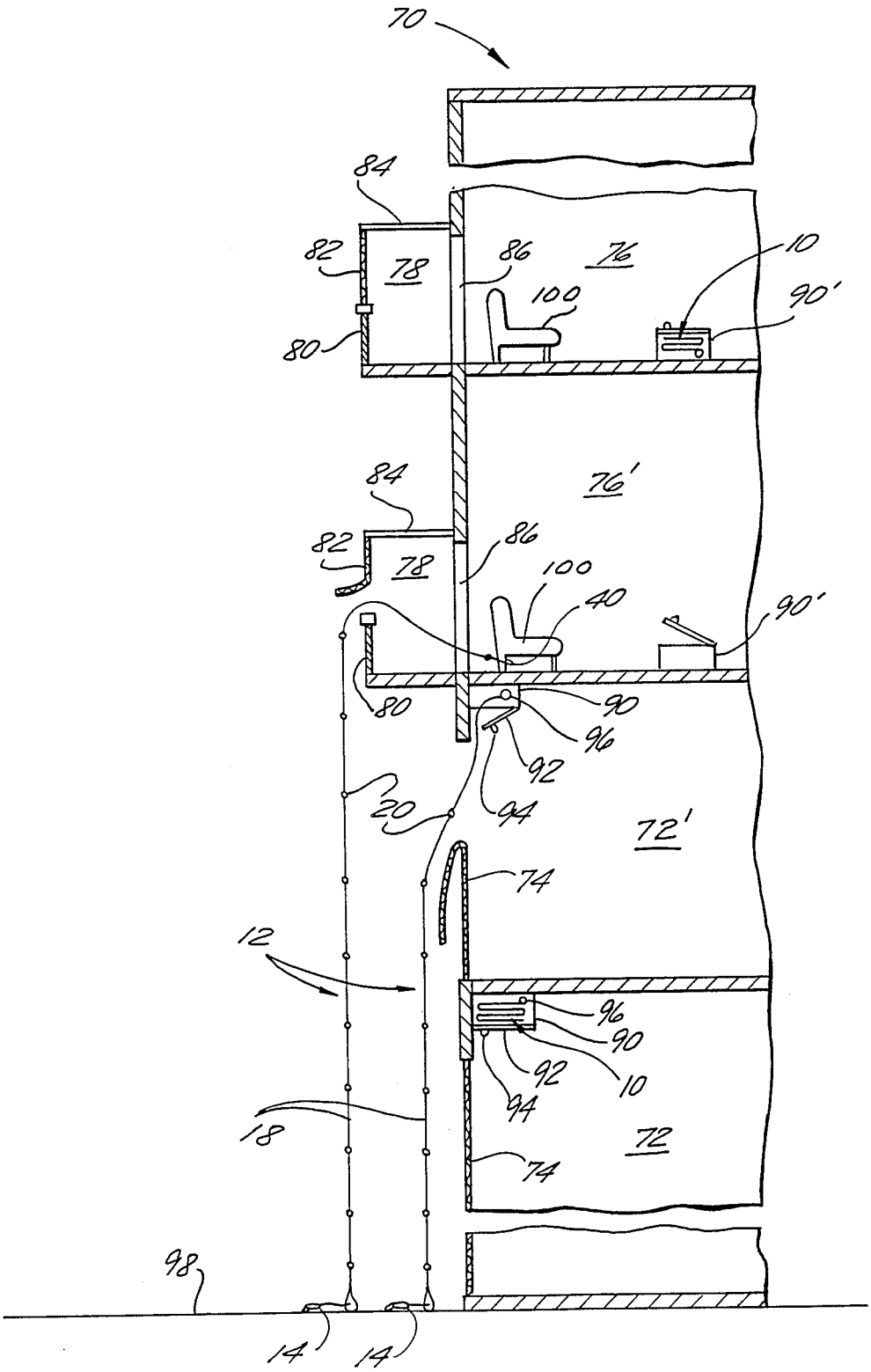
FIG. 4 is a fragmentary side elevation view, partially in cross-section, of an apartment building having apartments equipped with the fire escape device of the present invention.

Referring now to FIG. 4, therein illustrated is an apartment house generally designated by the reference numeral 70. The non-terraced apartments 72, 72' each have a large openable picture window (not shown) covered by a permanent screen 74, and the terraced apartments 76, 76' each have a terrace 78 with a solid railing 80 and a screen 82 extending upwardly from the railing 80 to the terrace roof 84. A doorway 86 provides passage between the apartment 76, 76' and its terrace 78.

Each of the various apartments is provided with a fire escape devices 10 according to the present invention. In apartments 72, 72' the fire escape devices 10 are ceiling mounted so as to be out of the way when not in use. More particularly, in apartment 72 the fire escape device 10 is shown maintained within a ceiling-mounted bottom-opening storage box 90 having a normally closed bottom 92 which can be opened by means of a handle 94 so that all but the top end 28 and hook 60 of the fire escape device 10 drop down available for use. The escape rope 18 is compactly disposed within box 90 as a hank (e.g., as a coil or skein of rope). The upper portion of the device 10 is secured to a structural element 96 of the building 70 or some other relatively stable element either by m eans of hook 40, loop 32, or other means discussed hereinabove.

To deploy the fire escape device 10 one has only to pull down on box handle 94; if the handle 94 is not within arm's reach, it should be provided with a chain or other dangling element enabling it to be easily manipulated by a tenant. The end of the escape means 12 secured to the cutting means 14 will drop down into the apartment, thereby making the cutting means 14 readily available for cutting through the screen 74. If necessary, the blade 52 may be easily exposed through use of positioning means 54 so that it may be used to cut through the screen 74. Once screen 74 has been cut and opened sufficiently to enable the occupants of the apartment to pass therethrough, the lower end 30 of the escape means 12 is thrown through the opening in the screen 74 and allowed to fall to the ground 98—or as close thereto as it extends—bearing with it the cutting means 14, as shown with respect to apartment 72'. Preferably, although not necessarily, the positioning means 54 is used to retract the blade 52 into the housing 50 before the cutting means 14 is ejected from the apartment in order to reduce the likelihood of injury below.

It will be appreciated that the placement of the storage box 90 adjacent the screen 74 faciliates use of the fire escape device 10 despite the presence of smoke within the apartment 72, 72'. Furthermore, the one-handed operation of the cutting means 14 facilitates its use even by a person in a panicked state.

It will be appreciated that even if the escape means 12 is too short to reach the ground 98, if it at least reaches the apartment immediately below (for example, going from apartment 72' to apartment 72), the cutting means 14 may be employed once again in order to cut the screen 74 of that apartment below to enable the person on the rope 18 to reach whatever safety is there afforded.

Alternatively, as shown in apartment 76, the fire escape device 10 may be compactly stored in a portable top-opening storage box 90' disposed in a closet or some other out-of-the-way location which still leaves the fire escape device 10 easily accessible, preferably near the screen 82. In the event of a fire, the fire escape device 10 is removed from the box 90'. As shown with regard to apartment 76', the upper rope end 28, loop 32 or hook 40 is secured about a relatively stable piece of furniture, such as a leg of a couch 100, and the lower rope end 30 bearing the cutting means 14 carried or dragged over to the screen 82 of terrace 78. The cutting means 14 is then employed on screen 82 and the lower rope end 30 finally thrown to the ground in generally the same manner previously described in connection with apartment 72'.

To summarize, the present invention provides a fire escape device for use in escaping from a structure through the screen of a screened-in area, the device enabling the fire escape rope and screen cutting blade to be stored in handy proximity to one another and brought to the screen together. The device further maintains the screen cutting knife such that it is accessible for use in cutting the screen of a screened-in area belonging to an apartment below, if necessary. Finally, the device is of sturdy, rugged and economical construction.

Now that the preferred embodiments of the present invention have been shown and described in detail, various modifications and improvements thereupon will become readily apparent to those skilled in the art. Accordingly, the spirit and scope of the present invention is to be limited only by the appended claims and not by the foregoing specification.

I claim:

1. A fire escape device for use in escaping from a structure through the screen of a screened-in area comprising in combination:

(a) elongate fire escape means comprising a rope having knots regularly spaced along a length thereof, a first end adapted to be secured to the structure and a second end adapted to be moved through the screen, said rope including a non-combustible core of fire-resistant wire extending from said first end for at least a length thereof;

(b) light weight screen cutting means comprising a knife with a blade having a dull cutting edge, said blade being movable between a first orientation exposing said cutting edge for cutting and a second orientation precluding said cutting edge from cutting; and (c) light weight means permanently securing said cutting means to said escape means adjacent said second end of said escape means.

* * * * *